US011859895B2

(12) United States Patent
Chhajed et al.

(10) Patent No.: US 11,859,895 B2
(45) Date of Patent: Jan. 2, 2024

(54) REFRIGERATION UNIT

(71) Applicant: Whirlpool Corporation, Benton Harbor, MI (US)

(72) Inventors: Rahul Subhash Chhajed, Pune (IN); Narendra Ashok Kapure, Pune (IN); Jackson Felipe Karl, Stevensville, MI (US); Abhay Naik, Stevensville, MI (US); Abinash Sarma, Tinsukia (IN); Subrata Shannigrahi, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/668,728

(22) Filed: Feb. 10, 2022

(65) Prior Publication Data

US 2023/0251026 A1 Aug. 10, 2023

(51) Int. Cl.
*F25D 23/06* (2006.01)

(52) U.S. Cl.
CPC ..... *F25D 23/062* (2013.01); *F25D 23/066* (2013.01)

(58) Field of Classification Search
CPC .... F25D 23/082; F25D 23/062; F25D 23/066; F25D 23/087; F25D 23/028
See application file for complete search history.

(56) References Cited

U.S. PATENT DOCUMENTS

| | | | | |
|---|---|---|---|---|
| 1,980,005 | A * | 11/1934 | Seeger | F25D 23/082 49/484.1 |
| 2,135,091 | A | 11/1938 | Newill | |
| 2,247,949 | A * | 7/1941 | Kucher | F25D 23/082 220/592.09 |
| 4,114,065 | A * | 9/1978 | Horvay | F25D 23/061 62/298 |
| 4,891,912 | A | 1/1990 | Bockwinkel | |
| 5,297,360 | A * | 3/1994 | Besore | F25D 23/087 49/492.1 |
| 7,204,568 | B2 * | 4/2007 | Lim | F25D 23/087 277/645 |
| 10,563,905 | B1 * | 2/2020 | Allard | F25D 23/028 |
| 10,655,906 | B2 | 5/2020 | Okazaki et al. | |

(Continued)

FOREIGN PATENT DOCUMENTS

| | | | |
|---|---|---|---|
| CN | 108027194 | A | 5/2018 |
| KR | 20000020955 | A | 4/2000 |

(Continued)

*Primary Examiner* — Daniel J Rohrhoff
(74) *Attorney, Agent, or Firm* — Price Heneveld LLP

(57) ABSTRACT

A refrigeration unit includes a cabinet, a door coupled to the cabinet, at least one gasket coupled to the door, and a heat loop conduit. The cabinet includes a front perimeter that surrounds an opening to a storage compartment within the cabinet. The door is operable between an open position to provide access to the storage compartment and a closed position to conceal the opening to the storage compartment. The at least one gasket is configured to be compressed between the door and the front perimeter of the cabinet in the closed position of the door. The heat loop conduit has a first conduit portion that extends around a majority of the opening along the front perimeter of the cabinet and a second conduit portion that extends around the majority of the opening along the front perimeter of the cabinet.

20 Claims, 5 Drawing Sheets

(56) References Cited

U.S. PATENT DOCUMENTS

| | | | | |
|---|---|---|---|---|
| 2006/0080995 | A1 | 4/2006 | An | |
| 2007/0252497 | A1* | 11/2007 | Kim | F25D 23/066 312/401 |
| 2014/0103791 | A1 | 4/2014 | Cheon | |
| 2018/0299060 | A1 | 10/2018 | Song et al. | |
| 2018/0328649 | A1* | 11/2018 | Okazaki | F25D 23/028 |
| 2020/0103161 | A1 | 4/2020 | Aoki et al. | |
| 2021/0123664 | A1* | 4/2021 | Okada | F25D 23/028 |
| 2022/0196313 | A1* | 6/2022 | Ros | F25D 17/047 |

FOREIGN PATENT DOCUMENTS

| | | | |
|---|---|---|---|
| KR | 20030085305 | A | 11/2003 |
| KR | 101622602 | B1 | 5/2016 |

* cited by examiner

REFRIGERATION UNIT

BACKGROUND OF THE DISCLOSURE

The present disclosure generally relates to a refrigeration unit and, more specifically, to a refrigeration unit having a door and a gasket coupled to the door.

SUMMARY OF THE DISCLOSURE

According to one aspect of the present disclosure, a refrigeration unit includes a cabinet that includes a front perimeter that surrounds an opening to a storage compartment within the cabinet and a door coupled to the cabinet and operable between an open position and a closed position. In the open position of the door, access to the storage compartment is provided. In the closed position of the door, the door conceals the opening to the storage compartment. The refrigeration unit also includes at least one gasket coupled to the door and configured to be compressed between the door and the front perimeter of the cabinet in the closed position of the door. The refrigeration compartment further includes a heat loop conduit having a first conduit portion that extends around a majority of the opening along the front perimeter of the cabinet and a second conduit portion that extends around the majority of the opening along the front perimeter of the cabinet.

According to another aspect of the present disclosure, a refrigeration unit includes a cabinet which includes an outer wrapper and an inner liner coupled to the outer wrapper. The inner liner defines a storage compartment within the cabinet and forms at least a portion of a front perimeter of the cabinet. The portion of the inner liner that defines the at least a portion of the front perimeter and the portion of the inner liner that defines the storage compartment are coupled to each other at a corner that defines an opening to the storage compartment. The portion of the inner liner that defines the storage compartment extends rearward and storage compartment-outboard from the corner of the inner liner to form a diverter portion. The refrigeration unit also includes a door coupled to the cabinet and operable between an open position and a closed position. In the open position of the door, access to the storage compartment is provided. In the closed position of the door, the door conceals the opening to the storage compartment. The refrigeration unit further includes at least one gasket coupled to the door and configured to be compressed between the door and the front perimeter of the cabinet in the closed position of the door. The diverter portion of the inner liner is configured to divert air from the storage compartment away from the at least one gasket.

According to yet another aspect of the present disclosure, a refrigeration unit includes a cabinet that includes a front perimeter that surrounds an opening to a storage compartment within the cabinet. The front perimeter includes a first shelf portion and a second shelf portion that defines the opening to the storage compartment and is nearer than the first shelf portion to a rear side of the cabinet. The refrigeration unit also includes a door coupled to the cabinet and operable between an open position and a closed position. In the open position of the door, access to the storage compartment is provided. In the closed position of the door, the door conceals the opening to the storage compartment. The refrigeration unit further includes a first gasket coupled to the door and configured to be compressed between the door and the first shelf portion of the front perimeter of the cabinet in the closed position of the door, and a second gasket coupled to the door and configured to be compressed between the door and the second shelf portion of the front perimeter of the cabinet in the closed position of the door.

These and other features, advantages, and objects of the present disclosure will be further understood and appreciated by those skilled in the art by reference to the following specification, claims, and appended drawings.

Figure 1C:
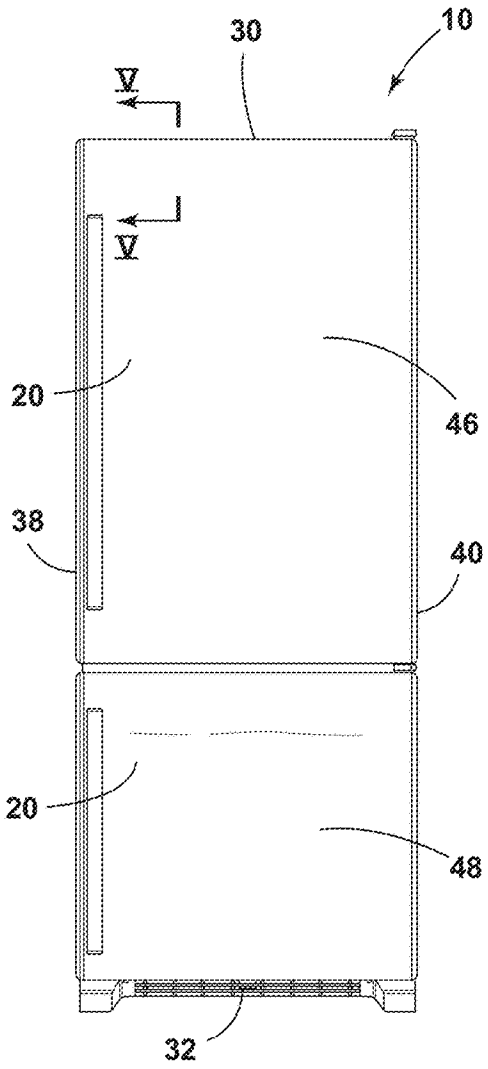
FIG. 1C is a front elevational view of a refrigeration unit.

The components in the figures are not necessarily to scale, emphasis instead being placed upon illustrating the principles described herein.

DETAILED DESCRIPTION

The present illustrated embodiments reside primarily in combinations of apparatus components related to a refrigeration unit. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

Figure 1B:
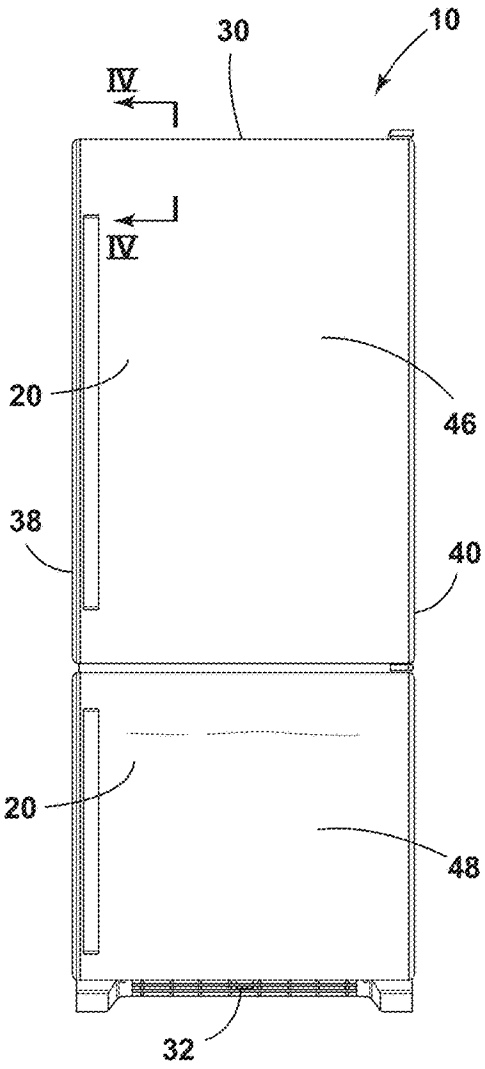
FIG. 1B is a front elevational view of a refrigeration unit.
Figure 1A:
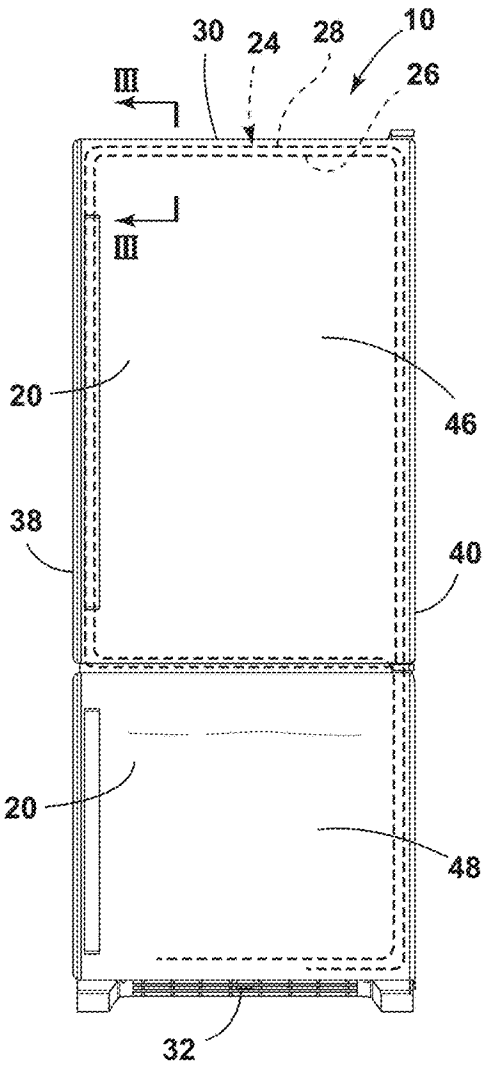
FIG. 1A is a front elevational view of a refrigeration unit, illustrating a heat loop conduit in phantom.

For purposes of description herein, the terms "upper," "lower," "right," "left," "rear," "front," "vertical," "horizontal," and derivatives thereof shall relate to the disclosure as oriented in FIG. 1A. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring now to FIGS. 1A-5, reference 10 generally designates a refrigeration unit. The refrigeration unit 10 includes a cabinet 12 that includes a front perimeter 14 that surrounds an opening 16 to a storage compartment 18 within the cabinet 12. A door 20 is coupled to the cabinet 12 and is operable between an open position, wherein access to the storage compartment 18 is provided, and a closed position, wherein the door 20 conceals the opening 16 to the storage compartment 18. At least one gasket 22 is coupled to the door 20 and is configured to be compressed between the door 20 and the front perimeter 14 of the cabinet 12 in the closed position of the door 20. A heat loop conduit 24 includes a first conduit portion 26 that extends around a majority of the opening 16 along the front perimeter 14 of the cabinet 12 and a second conduit portion 28 that extends around the majority of the opening 16 along the front perimeter 14 of the cabinet 12.

Figure 2:
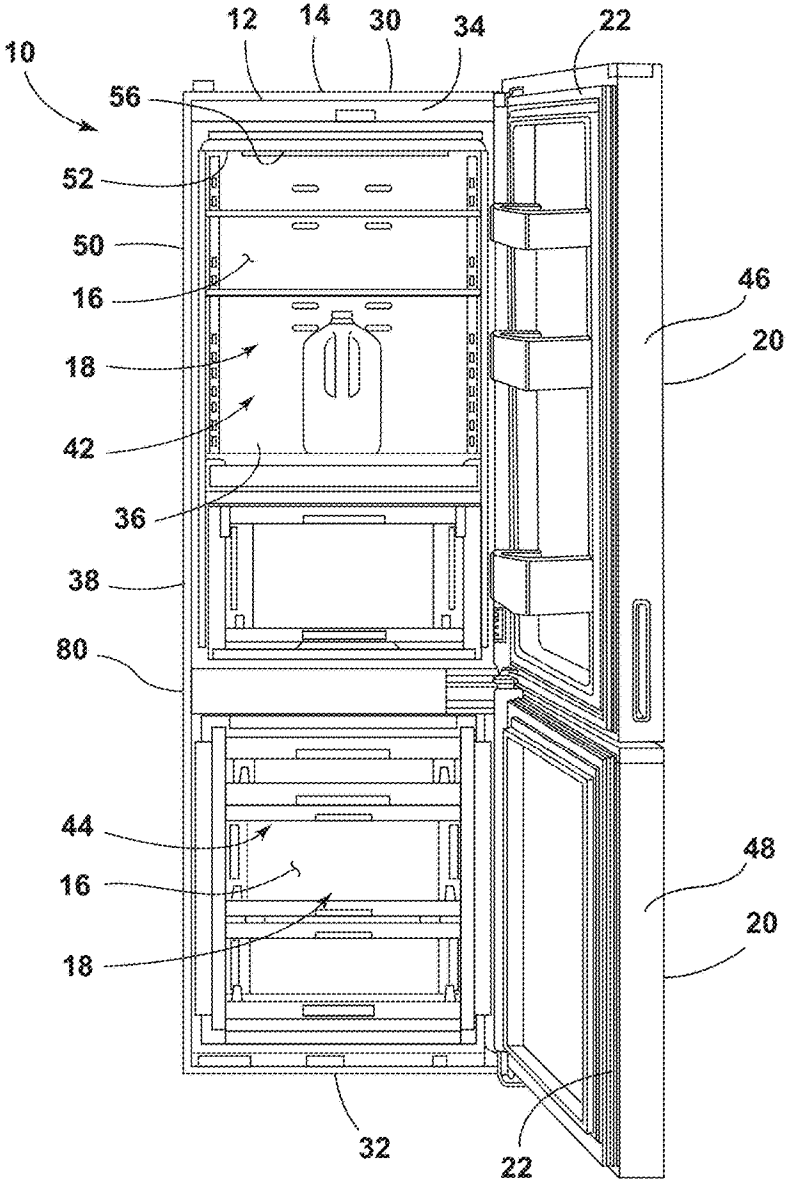
FIG. 2 is a front elevational view of a refrigeration unit illustrating a door of the refrigeration unit in an open position and a storage compartment within the refrigeration unit.

Referring now to FIGS. 1A-2, the refrigeration unit 10 includes a top 30 and a bottom 32 opposite the top 30. A front side 34 and a rear side 36 opposite the front side 34 extend between the top 30 and the bottom 32. A right side 40 and a left side 38 opposite the right side 40 are disposed between the front and rear sides 34, 36 and extend between the top 30 and the bottom 32. The refrigeration unit 10 includes at least one storage compartment 18 in which items are configured to be stored in a temperature-controlled environment. In the embodiments illustrated in FIGS. 1A-2, the refrigeration unit 10 includes two storage compartments 18—a refrigerator compartment 42 and a freezer compartment 44. The refrigeration unit 10 further includes at least one door 20. In the embodiments illustrated in FIGS. 1A-2, the refrigeration unit includes two doors 20—a refrigerator compartment door 46 and a freezer compartment door 48. The refrigerator and freezer compartment doors 46, 48 are coupled to the refrigeration unit proximate to the front side 34 and are operable between closed and open positions. In the closed position (illustrated in FIGS. 1A-1C), the door 20 conceals the opening 16 to the corresponding storage compartment 18. In the open position of the door 20, as illustrated in FIG. 2, the access to the storage compartment 18 that corresponds with the door 20 is provided. A variety of styles of refrigeration units 10 with varying numbers of storage compartments and/or doors are contemplated. With reference to FIGS. 1A-2, the refrigerator compartment 42 is positioned nearer than the freezer compartment 44 to the top 30 of the refrigeration unit 10. As such, the refrigeration unit 10 is configured as a bottom-freezer refrigeration unit.

Referring now to FIGS. 2-5, the refrigeration unit 10 includes the cabinet 12. The cabinet 12 defines the storage compartment 18 of the refrigeration unit 10. As illustrated in FIG. 2, the cabinet 12 includes the front perimeter 14. The front perimeter 14 can surround the opening 16 to the storage compartment 18 of the refrigeration unit 10. In various implementations, the front perimeter 14 of the cabinet 12 defines the opening 16 to the storage compartment 18.

Figure 3:
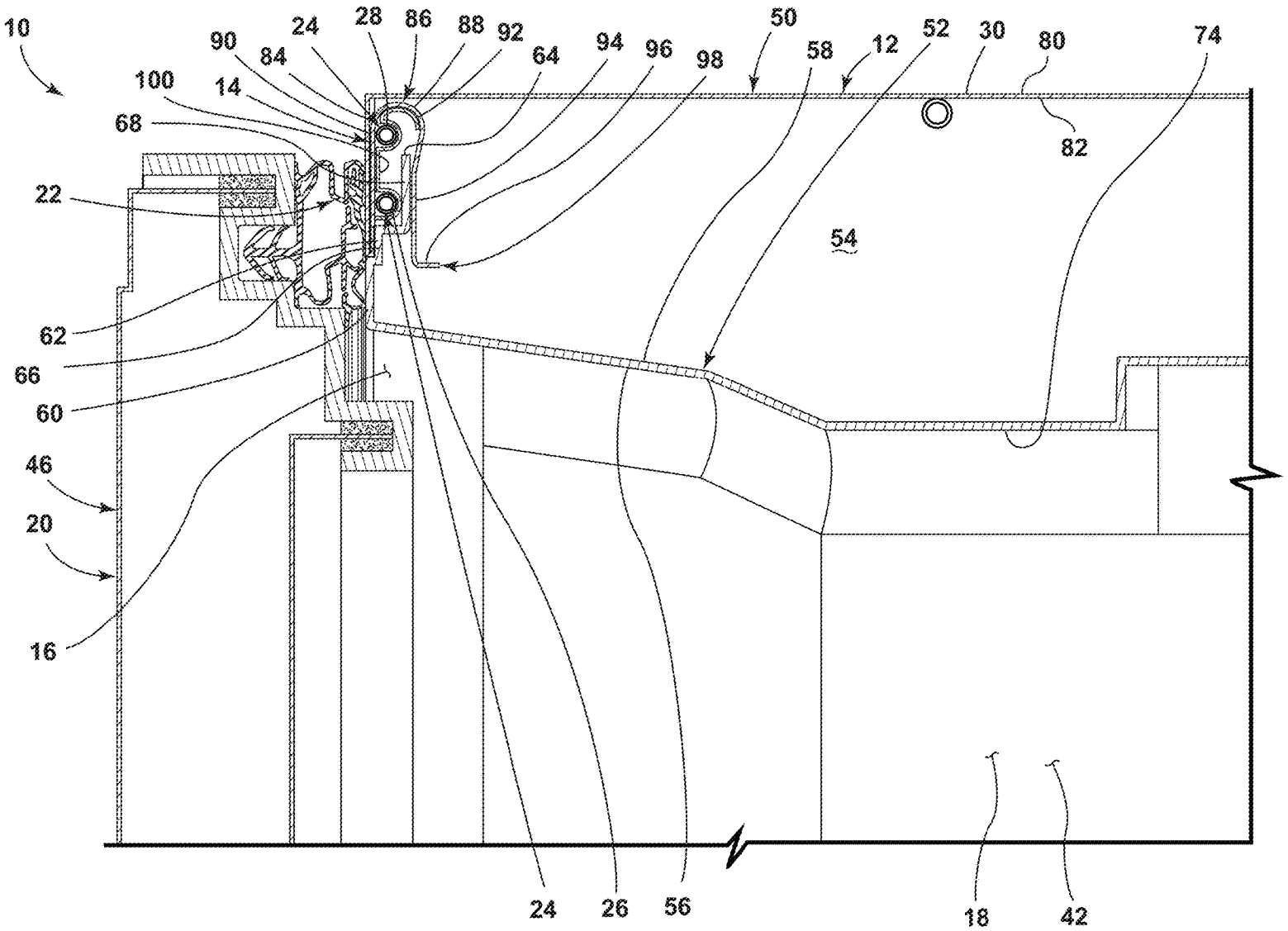
FIG. 3 is a cross-sectional view of a portion of the refrigeration unit of FIG. 1A taken at line III-Ill showing a heat loop conduit proximate to a gasket coupled to a door of the refrigeration unit.
Figure 4:
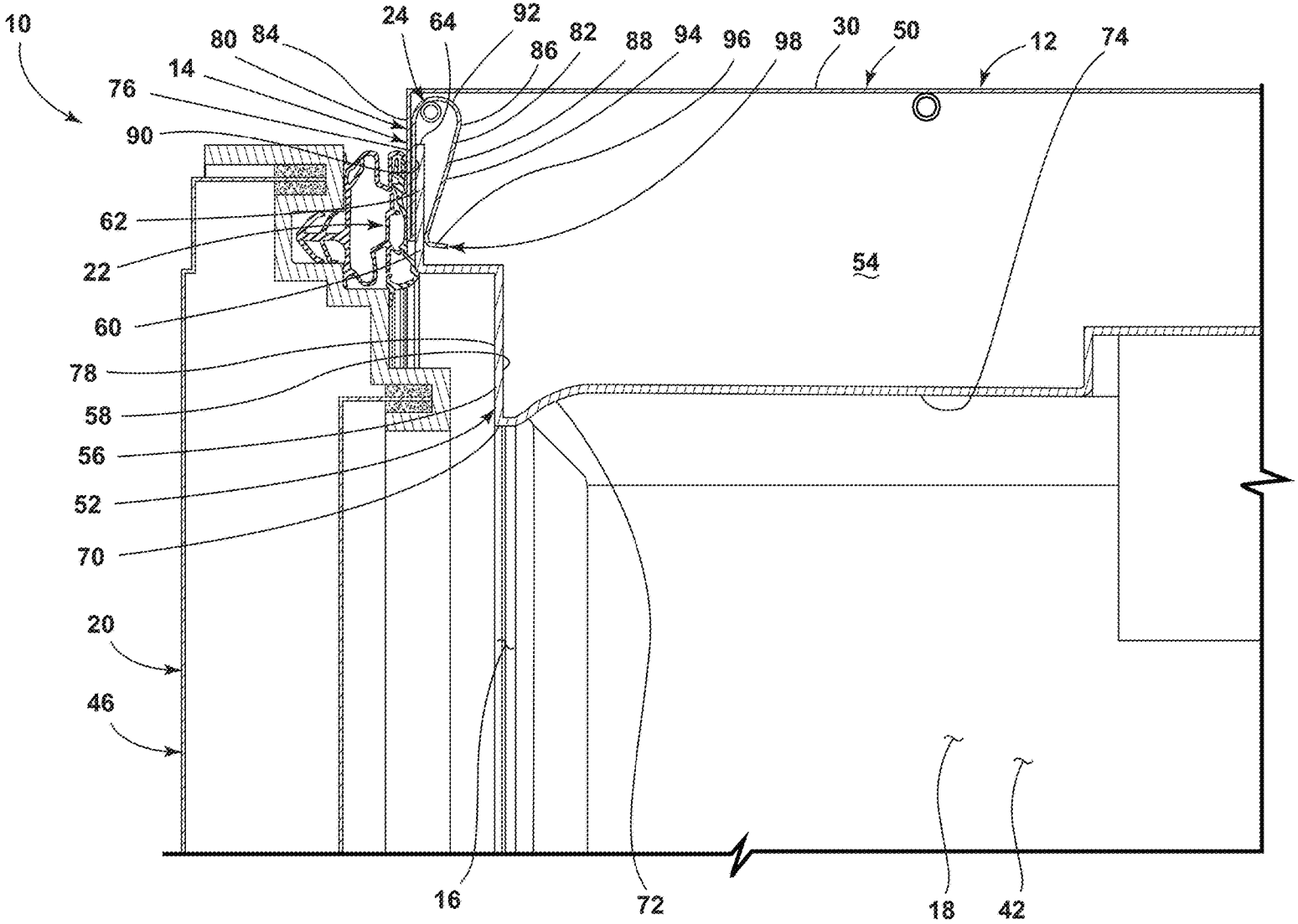
FIG. 4 is a cross-sectional view of a portion of the refrigeration unit of FIG. 1B taken at line IV-IV showing an inner liner that includes a diverter portion.
Figure 5:
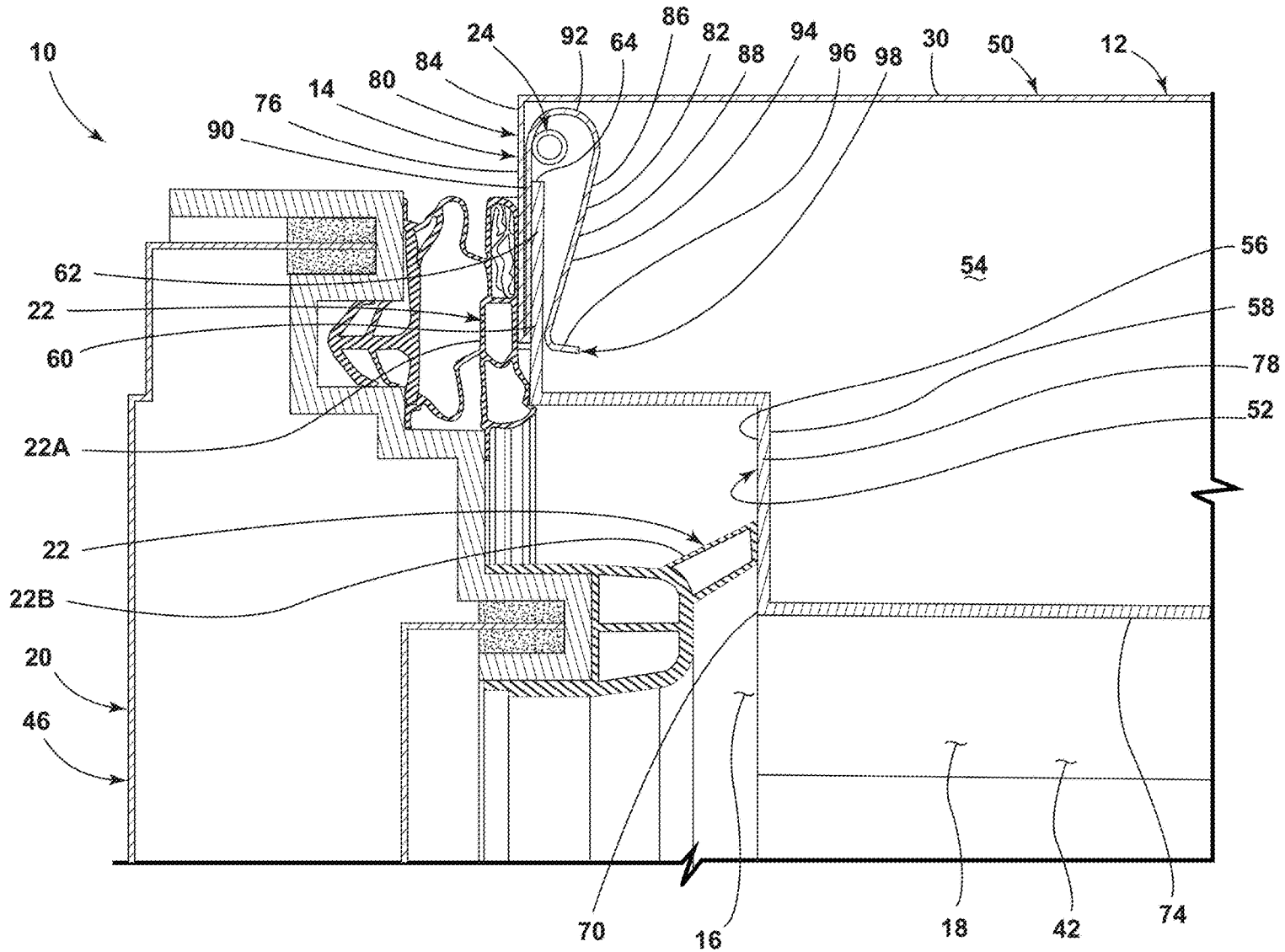
FIG. 5 is a cross-sectional view of a portion of the refrigeration unit of FIG. 1C taken at line V-V showing a door and first and second gaskets coupled to the door and compressed between the door and a cabinet of the refrigeration unit.

Referring still to FIGS. 2-5, the cabinet 12 includes an outer wrapper 50 and an inner liner 52. The outer wrapper 50 and the inner liner 52 define a cabinet interior 54. In various implementations, the cabinet interior 54 is filled at least partially with insulation, such that the refrigeration unit 10 is insulated. The cabinet 12 can be insulated via a variety of materials and/or methods. For example, the cabinet 12 may include foam insulation, in various embodiments. The outer wrapper 50 and the inner liner 52 of the cabinet 12 can cooperate to form the front perimeter 14 of the refrigeration unit 10, as illustrated in FIGS. 3-5, as described further herein.

Referring now to FIGS. 3-5, the inner liner 52 includes a first liner side 56 and a second liner side 58 that is opposite the first liner side 56. In various embodiments, a portion of the first liner side 56 at least partially defines the storage compartment 18 of the refrigeration unit 10. As illustrated in FIGS. 3-5, a portion of the first liner side 56 of the inner liner 52 defines the storage compartment 18 of the refrigeration unit 10. It is contemplated that one or more other components of the refrigeration unit 10 can define the storage compartment 18 of the refrigeration unit 10 together with the portion of the inner liner 52. The inner liner 52 includes a first liner portion 60 and a second liner portion 62. In the embodiments illustrated in FIGS. 3-5, the first liner portion 60 forms the front perimeter 14 of the cabinet 12 together with the outer wrapper 50. For example, as illustrated in FIG. 3, the first liner side 56 of the first liner portion 60 forms an exterior surface of the front perimeter 14 of the cabinet 12 together with the outer wrapper 50, as described further herein. The second liner portion 62 extends from the first liner portion 60 into the cabinet interior 54. In the embodiments illustrated in FIGS. 3-5, the second liner portion 62 extends from the first liner portion 60 to a terminus 64 that is upward of the first liner portion 60.

Referring now to FIG. 3, in some implementations, the second liner portion 62 includes a first step portion 66 and a second step portion 68. The first step portion 66 is further than the first liner portion 60 of the inner liner 52 from the opening 16 to the storage compartment 18, and the second step portion 68 is further than the first step portion 66 from the opening 16 to the storage compartment 18. In various implementations, the first liner side 56 of the first step portion 66 is a first distance from the front perimeter 14 of the cabinet 12, and the first liner side 56 of the second step portion 68 is a second distance from the front perimeter 14 of the cabinet 12, wherein the second distance is greater than the first distance. The first liner side 56 of the first step portion 66 can be substantially parallel to the first liner side 56 of the second step portion 68. For example, in the embodiment illustrated in FIG. 3, the first liner side 56 of the first step portion 66 is substantially parallel to the first liner side 56 of the second step portion 68, and the first liner side 56 of both the first and second step portions 66, 68 are substantially parallel to the first liner side 56 of the first liner portion 60.

Referring now to FIG. 4, in various embodiments, a portion of the inner liner 52 defines the storage compartment 18 within the cabinet 12, and a portion of the inner liner 52 forms at least a portion of the front perimeter 14 of the cabinet 12. As illustrated in FIG. 4, the portion of the inner liner 52 that defines the at least a portion of the front perimeter 14 and the portion of the inner liner 52 that defines the storage compartment 18 are coupled to each other at a corner 70. The corner 70 defines the opening 16 to the storage compartment 18. In the embodiment illustrated in FIG. 4, the portion of the inner liner 52 that defines the storage compartment 18 extends rearward (i.e., generally toward the rear side 36 of the refrigeration unit 10) and storage compartment-outboard from the corner 70 of the inner liner 52 to form a diverter portion 72. As shown in FIG.

4, the diverter portion 72 extends upward and rearward from the corner 70 of the inner liner 52, such that the opening 16 defined by the corner 70 is generally narrower than a parallel space positioned within the storage compartment 18, rearward of the opening 16. In FIG. 4, this is represented by the portion of the inner liner 52 that constitutes a ceiling 74 of the storage compartment 18 being further upward than the corner 70 of the inner liner 52.

Referring now to FIGS. 4 and 5, the front perimeter 14 of the cabinet 12 can include a first shelf portion 76 and a second shelf portion 78. In various implementations, the second shelf portion 78 is nearer than the first shelf portion 76 to the rear side 36 of the refrigeration unit 10. For example, as illustrated in FIGS. 4 and 5, the second shelf portion 78 of the front perimeter 14 is generally recessed relative to the first shelf portion 76 of the front perimeter 14. Further, in the illustrated embodiments, the first shelf portion 76 and the second shelf portion 78 are generally parallel to each other.

Referring now to FIGS. 2-5, the outer wrapper 50 of the cabinet 12 includes a first wrapper side 80 and a second wrapper side 82 that is opposite the first wrapper side 80. As illustrated in FIGS. 3-5, the outer wrapper 50 can include a first wrapper portion 84 and a second wrapper portion 86. The first wrapper side 80 of the first wrapper portion 84 can form the front perimeter 14 of the cabinet 12 together with the first liner portion 60 of the inner liner 52. The second wrapper portion 86 extends from the first wrapper portion 84 into the cabinet interior 54. In various implementations, the second wrapper portion 86 includes a retainer 88 that couples the outer wrapper 50 to the inner liner 52. In the embodiments illustrated in FIGS. 3-5, the second wrapper portion 86 of the outer wrapper 50 comprises a retainer 88 that includes a first elongated section 90 that extends from the first wrapper portion 84 to an arcuate section 92 of the retainer 88, a second elongated section 94 that extends outward from the arcuate section 92, and a tang 96 that extends outward from the second elongated section 94 to a retainer terminus 98. It is contemplated that the second wrapper portion 86 of the outer wrapper 50 may form a variety of types of retainers, in various implementations.

Referring now to FIGS. 3-5, in some implementations, the first wrapper side 80 of the second wrapper portion 86 contacts the first and/or second liner sides 56, 58 of the second liner portion 62. For example, as illustrated in FIGS. 4 and 5, the first wrapper side 80 of the first elongated section 90 contacts the first liner side 56 of the second liner portion 62, and the first wrapper side 80 of the second elongated section 94 contacts the second liner side 58 of the second liner portion 62. In the embodiment illustrated in FIG. 3, the first wrapper side 80 of the first elongated section 90 of the retainer 88 of the second wrapper portion 86 contactingly extends along the first liner side 56 of the first step portion 66 of the inner liner 52. Further, the first wrapper side 80 of the second elongated section 94 of the retainer 88 of the second wrapper portion 86 contactingly extends along the second liner side 58 of the second step portion 68 of the second liner portion 62 of the inner liner 52.

Referring now to FIGS. 1A and 3-5, the refrigeration unit 10 includes a heat loop conduit 24. As used herein, the heat loop conduit 24 may refer to at least one of a Yoder loop conduit and a pre-condenser loop conduit. The heat loop conduit 24 is disposed within the cabinet interior 54 and extends along the front perimeter 14 of the cabinet 12. The heat loop conduit 24 can extend around a majority of the opening 16 to the storage compartment 18 along the front perimeter 14 of the cabinet 12. In some implementations, the heat loop conduit 24 extends entirely around the opening 16 to the storage compartment 18 along the front perimeter 14. In operation of the refrigeration unit 10, the heat loop conduit 24 may be configured to emit heat which is transferred through the front perimeter 14 of the cabinet 12 to the at least one gasket 22 coupled to the door 20 of the refrigeration unit 10 in the closed position of the door 20 to prevent condensation from freezing on the gasket 22, as described further herein.

Referring now to FIGS. 1A and 3, in some implementations, the heat loop conduit 24 includes the first conduit portion 26 and the second conduit portion 28. The first and second conduit portions 26, 28 may be adjacent sections of the heat loop conduit 24. In various implementations, the first conduit portion 26 and/or the second conduit portion 28 extends around a majority of the opening 16 along the front perimeter 14 of the cabinet 12. For example, as illustrated in FIG. 1A, the heat loop conduit 24 includes the first conduit portion 26 that extends around the opening 16 to the storage compartment 18 along the front perimeter 14 of the cabinet 12, and the second conduit portion 28 that extends around the majority of the opening 16 along the front perimeter 14 of the cabinet 12. It is contemplated that the first and/or second conduit portions 26, 28 may extend entirely around the opening 16 along the front perimeter 14 of the cabinet 12, in some implementations.

As illustrated in FIG. 3, the first and second conduit portions 26, 28 are disposed within the cabinet interior 54, proximate to the front perimeter 14 of the cabinet 12. The first conduit portion 26 can extend between the first liner side 56 of the second liner portion 62 and the front perimeter 14 of the cabinet 12. For example, in the embodiment illustrated in FIG. 3, the first conduit portion 26 is positioned between the second step portion 68 of the inner liner 52 and the first elongated section 90 of the retainer 88 of the outer wrapper 50. Further, the second conduit portion 28 is positioned upward of the first conduit portion 26 within the space defined by the first elongated section 90, the arcuate section 92, and the second elongated section 94 of the retainer 88.

Referring still to FIG. 3, the refrigeration unit 10 may include a retention clip 100. The retention clip 100 may be disposed within the cabinet interior 54 and may be coupled to the first and second conduit portions 26, 28 of the heat loop conduit 24. In the embodiment illustrated in FIG. 3, the retention clip 100 extends along the first wrapper side 80 of the arcuate section 92 of the retainer 88, around a majority of the circumference of the second conduit portion 28, along the first wrapper side 80 of the first elongated section 90 of the retainer 88, and around a majority of the circumference of the first conduit portion 26. The retention clip 100 may maintain the first and second conduit portions 26, 28 in position relative to each other and/or relative to other components of the refrigeration unit 10.

Referring now to FIGS. 3-5, at least one gasket 22 is coupled to the door 20 of the refrigeration unit 10. The at least one gasket 22 is configured to be compressed between the door 20 and the front perimeter 14 of the cabinet 12 in the closed position of the door 20. Compression of the at least one gasket 22 between the door 20 and the front perimeter 14 of the cabinet 12 is configured to form a seal between the door 20 and the cabinet 12, such that air is generally prevented from entering and exiting the storage compartment 18 via the opening 16 concealed by the door 20 in the closed position. Sealing the opening 16 to the storage compartment 18 in this manner may aid in maintaining the temperature-controlled environment within the storage compartment 18 of the refrigeration unit 10.

The at least one gasket 22 can be compressed between the door 20 and the first and/or second shelf portions 76, 78 of the front perimeter 14 of the cabinet 12, in some implementations. For example, as illustrated in FIG. 4, the at least one gasket 22 is compressed between the door 20 and the first shelf portion 76 of the front perimeter 14. In some implementations, the at least one gasket 22 includes a plurality of gaskets 22. For example, in the embodiment illustrated in FIG. 5, first and second gaskets 22A, 22B are coupled to the door 20. In the illustrated embodiment, the first gasket 22A is configured to be compressed between the door 20 and the first shelf portion 76 of the front perimeter 14 in the closed position of the door and the second gasket 22B is configured to be compressed between the door 20 and the second shelf portion 78 of the front perimeter 14 of the cabinet 12 in the closed position of the door 20.

Referring now to FIGS. 1A and 3, in operation of an exemplary embodiment of the refrigeration unit 10, wherein the refrigeration unit 10 includes the heat loop conduit 24 having the first and second conduit portions 26, 28, the first and second conduit portions 26, 28 extend within the cabinet interior 54 along the front perimeter 14 of the cabinet 12. The first and second conduit portions 26, 28 emit heat that warms the at least one gasket 22 that is compressed between the door 20 and front perimeter 14 of the cabinet 12, such that condensation does not freeze on the gasket 22.

Referring now to FIGS. 1B and 4, an exemplary embodiment of the refrigeration unit 10 is illustrated, wherein the door 20 is a vacuum insulated door 20, and the inner liner 52 includes the diverter portion 72. The diverter portion 72 of the inner liner 52 is configured to divert air circulating within the storage compartment 18 away from the at least one gasket 22 that is compressed between the front perimeter 14 of the cabinet 12 and the door 20 in the closed position of the door 20.

Referring now to FIGS. 1C and 5, an exemplary embodiment of the refrigeration unit 10, wherein the first and second gaskets 22A, 22B are coupled to the door 20, is illustrated. In operation of the exemplary embodiment, the second gasket 22B generally prevents air from within the storage compartment 18 from flowing to the first gasket 22A in the closed position of the door 20. As such, condensation is generally prevented from accumulating and freezing on the first gasket 22A during operation of the refrigeration unit 10.

According to one aspect of the present disclosure, a refrigeration unit includes a cabinet that includes a front perimeter that surrounds an opening to a storage compartment within the cabinet and a door coupled to the cabinet and operable between an open position and a closed position. In the open position of the door, access to the storage compartment is provided. In the closed position of the door, the door conceals the opening to the storage compartment. The refrigeration unit also includes at least one gasket coupled to the door and configured to be compressed between the door and the front perimeter of the cabinet in the closed position of the door. The refrigeration compartment further includes a heat loop conduit having a first conduit portion that extends around a majority of the opening along the front perimeter of the cabinet and a second conduit portion that extends around the majority of the opening along the front perimeter of the cabinet.

According to another aspect, the cabinet includes an outer wrapper and an inner liner coupled to the outer wrapper. The inner liner and outer wrapper cooperate to form the front perimeter and define a cabinet interior. The first and second conduit portions are positioned within the cabinet interior.

According to another aspect, the inner liner includes a first liner side and a second liner side opposite the first liner side. A portion of the first liner side defines the storage compartment.

According to another aspect, the inner liner includes a first liner portion that forms the front perimeter of the cabinet together with the outer wrapper and a second liner portion that extends from the first liner portion into the cabinet interior. The first conduit portion extends between the first liner side of the second liner portion and the front perimeter of the cabinet.

According to another aspect, the outer wrapper includes a first wrapper side and a second wrapper side opposite the first wrapper side.

According to another aspect, the outer wrapper includes a first wrapper portion and a second wrapper portion. The first wrapper side of the first wrapper portion forms the front perimeter of the cabinet together with the first liner portion. The second wrapper portion extends from the first wrapper portion into the cabinet interior. The first wrapper side of the second wrapper portion contacts the first and second liner sides of the second liner portion.

According to another aspect, a retention clip is coupled to the first conduit portion, the second conduit portion, and the first wrapper side of the second wrapper portion.

According to another aspect, the second liner portion includes a first step portion that is further than the first liner portion from the opening to the storage compartment. The first liner side of the first step portion is a first distance from the front perimeter of the cabinet. The second liner portion also includes a second step portion that is further than the first step portion from the opening to the storage compartment. The first liner side of the second step portion is a second distance from the front perimeter of the cabinet. Further, the second distance is greater than the first distance.

According to another aspect, the first liner side of the first liner portion is substantially parallel to the first liner side of the first step portion and the first liner side of the second step portion.

According to another aspect, the first conduit portion extends between the second step portion and the front perimeter of the cabinet.

According to another aspect, the outer wrapper contacts the second liner side of the second step portion and the first liner side of the first step portion.

According to another aspect, the door is a vacuum insulated door.

According to yet another aspect, the cabinet is a foam insulated cabinet.

According to another aspect, a refrigeration unit includes a cabinet which includes an outer wrapper and an inner liner coupled to the outer wrapper. The inner liner defines a storage compartment within the cabinet and forms at least a portion of a front perimeter of the cabinet. The portion of the inner liner that defines the at least a portion of the front perimeter and the portion of the inner liner that defines the storage compartment are coupled to each other at a corner that defines an opening to the storage compartment. The portion of the inner liner that defines the storage compartment extends rearward and storage compartment-outboard from the corner of the inner liner to form a diverter portion. The refrigeration unit also includes a door coupled to the cabinet and operable between an open position and a closed position. In the open position of the door, access to the storage compartment is provided. In the closed position of the door, the door conceals the opening to the storage compartment. The refrigeration unit further includes at least one gasket coupled to the door and configured to be compressed between the door and the front perimeter of the cabinet in the closed position of the door. The diverter portion of the inner liner is configured to divert air from the storage compartment away from the at least one gasket.

According to another aspect, the front perimeter includes a first shelf portion and a second shelf portion. The second shelf portion is nearer than the first shelf portion to a rear side of the cabinet and the at least one gasket is configured to be compressed between the door and the first shelf portion of the front perimeter.

According to another aspect, a heat loop conduit is disposed within a cabinet interior and extends along the front perimeter of the cabinet.

According to another aspect, the door is a vacuum insulated door.

According to yet another aspect, the cabinet is a foam insulated cabinet.

According to another aspect, a refrigeration unit includes a cabinet that includes a front perimeter that surrounds an opening to a storage compartment within the cabinet. The front perimeter includes a first shelf portion and a second shelf portion that defines the opening to the storage compartment and is nearer than the first shelf portion to a rear side of the cabinet. The refrigeration unit also includes a door coupled to the cabinet and operable between an open position and a closed position. In the open position of the door, access to the storage compartment is provided. In the closed position of the door, the door conceals the opening to the storage compartment. The refrigeration unit further includes a first gasket coupled to the door and configured to be compressed between the door and the first shelf portion of the front perimeter of the cabinet in the closed position of the door, and a second gasket coupled to the door and configured to be compressed between the door and the second shelf portion of the front perimeter of the cabinet in the closed position of the door.

According to another aspect, the first and second shelf portions are substantially parallel to each other.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A refrigeration unit, comprising:

a cabinet that includes a front perimeter that surrounds an opening to a storage compartment within the cabinet;

a door coupled to the cabinet and operable between an open position, wherein access to the storage compartment is provided, and a closed position, wherein the door conceals the opening to the storage compartment;

at least one gasket coupled to the door and configured to be compressed between the door and the front perimeter of the cabinet in the closed position of the door; and a heat loop conduit having a first conduit portion that extends around a majority of the opening along the front perimeter of the cabinet and a second conduit portion that extends around the majority of the opening along the front perimeter of the cabinet.

2. The refrigeration unit of claim 1, wherein the cabinet comprises:

an outer wrapper; and an inner liner coupled to the outer wrapper, wherein the inner liner and outer wrapper cooperate to form the front perimeter and define a cabinet interior, wherein the first and second conduit portions are positioned within the cabinet interior.

3. The refrigeration unit of claim 2, wherein the inner liner comprises:

a first liner side; and a second liner side opposite the first liner side, wherein a portion of the first liner side defines the storage compartment.

4. The refrigeration unit of claim 3, wherein the inner liner comprises:

a first liner portion that forms the front perimeter of the cabinet together with the outer wrapper; and a second liner portion that extends from the first liner portion into the cabinet interior, wherein the first conduit portion extends between the first liner side of the second liner portion and the front perimeter of the cabinet.

5. The refrigeration unit of claim 4, wherein the outer wrapper comprises:

a first wrapper side; and a second wrapper side opposite the first wrapper side.

6. The refrigeration unit of claim 5, wherein the outer wrapper comprises:

a first wrapper portion, wherein the first wrapper side of the first wrapper portion forms the front perimeter of the cabinet together with the first liner portion; and a second wrapper portion that extends from the first wrapper portion into the cabinet interior, wherein the first wrapper side of the second wrapper portion contacts the first and second liner sides of the second liner portion.

7. The refrigeration unit of claim 6, further comprising:

a retention clip that is coupled to the first conduit portion, the second conduit portion, and the first wrapper side of the second wrapper portion.

8. The refrigeration unit of claim 4, wherein the second liner portion comprises:

a first step portion that is further than the first liner portion from the opening to the storage compartment, wherein the first liner side of the first step portion is a first distance from the front perimeter of the cabinet; and a second step portion that is further than the first step portion from the opening to the storage compartment, wherein the first liner side of the second step portion is a second distance from the front perimeter of the cabinet, wherein the second distance is greater than the first distance.

9. The refrigeration unit of claim 8, wherein the first liner side of the first liner portion is substantially parallel to the first liner side of the first step portion and the first liner side of the second step portion.

10. The refrigeration unit of claim 8, wherein the first conduit portion extends between the second step portion and the front perimeter of the cabinet.

11. The refrigeration unit of claim 8, wherein the outer wrapper contacts the second liner side of the second step portion and the first liner side of the first step portion.

12. The refrigeration unit of claim 1, wherein the door is a vacuum insulated door.

13. The refrigeration unit of claim 12, wherein the cabinet is a foam insulated cabinet.

14. A refrigeration unit, comprising:

a cabinet, comprising:

an outer wrapper; and an inner liner coupled to the outer wrapper, wherein the inner liner defines a storage compartment within the cabinet and forms at least a portion of a front perimeter of the cabinet, wherein the portion of the inner liner that defines the at least a portion of the front perimeter and the portion of the inner liner that defines the storage compartment are coupled to each other at a corner that defines an opening to the storage compartment, and wherein the portion of the inner liner that defines the storage compartment extends rearward and storage compartment-outboard from the corner of the inner liner to form a diverter portion;

a door coupled to the cabinet and operable between an open position, wherein access to the storage compartment is provided, and a closed position, wherein the door conceals the opening to the storage compartment; and at least one gasket coupled to the door and configured to be compressed between the door and the front perimeter of the cabinet in the closed position of the door, wherein the diverter portion of the inner liner is configured to divert air from the storage compartment away from the at least one gasket.

15. The refrigeration unit of claim 14, wherein the front perimeter comprises:

a first shelf portion; and a second shelf portion, wherein the second shelf portion is nearer than the first shelf portion to a rear side of the cabinet and the at least one gasket is configured to be compressed between the door and the first shelf portion of the front perimeter.

16. The refrigeration unit of claim 14, further comprising:

a heat loop conduit that is disposed within a cabinet interior and that extends along the front perimeter of the cabinet.

17. The refrigeration unit of claim 14, wherein the door is a vacuum insulated door.

18. The refrigeration unit of claim 17, wherein the cabinet is a foam insulated cabinet.

19. A refrigeration unit, comprising:

a cabinet that includes a front perimeter that is formed by an outer wrapper and an inner liner of the cabinet and that surrounds an opening to a storage compartment within the cabinet, the front perimeter comprising:

a first shelf portion that is formed by the outer wrapper and the inner liner; and a second shelf portion that is formed by the inner liner, defines the opening to the storage compartment, and is nearer than the first shelf portion to a rear side of the cabinet;

a door coupled to the cabinet and operable between an open position, wherein access to the storage compartment is provided, and a closed position, wherein the door conceals the opening to the storage compartment;

a first gasket coupled to the door and configured to be compressed between the door and the first shelf portion of the front perimeter of the cabinet in the closed position of the door, such that the first gasket contacts both the outer wrapper and the inner liner; and a second gasket coupled to the door and configured to be compressed between the door and the second shelf portion of the front perimeter of the cabinet in the closed position of the door.

20. The refrigeration unit of claim 19, wherein the first and second shelf portions are substantially parallel to each other.

* * * * *